US005954496A

United States Patent [19]

Döbbeling et al.

[11] Patent Number: 5,954,496

[45] Date of Patent: Sep. 21, 1999

[54] BURNER FOR OPERATING A COMBUSTION CHAMBER

[75] Inventors: Klaus Döbbeling, Windisch; Hans Peter Knöpfel, Besenbüren; Donald Frank Walker, Gebenstorf, all of Switzerland

[73] Assignee: ABB Research Ltd., Zurich, Switzerland

[21] Appl. No.: 08/919,476

[22] Filed: Aug. 28, 1997

[30] Foreign Application Priority Data

Sep. 25, 1996 [DE] Germany ..... 196 30 301

[51] Int. Cl.[6] ..... F23D 14/62

[52] U.S. Cl. ..... 431/354; 431/185; 431/116; 431/115

[58] Field of Search ..... 431/350, 185, 431/182, 354, 159, 8, 9, 351, 183, 115, 116

[56] References Cited

U.S. PATENT DOCUMENTS

| | | | |
|---|---|---|---|
| 3,455,641 | 7/1969 | Poole . | |
| 3,570,242 | 3/1971 | Leonardi et al. . | |
| 3,687,602 | 8/1972 | Vignes . | |
| 3,927,958 | 12/1975 | Quinn | 431/116 |
| 4,561,841 | 12/1985 | Korenyi . | |
| 5,251,447 | 10/1993 | Joshi et al. | 431/185 |
| 5,588,826 | 12/1996 | Dobbeling et al. | 431/354 |
| 5,735,687 | 4/1998 | Knopfel et al. | 431/354 |

FOREIGN PATENT DOCUMENTS

| | | | |
|---|---|---|---|
| 0704657A2 | 4/1996 | European Pat. Off. . | |
| 3702415 | 4/1988 | Germany | 431/353 |

*Primary Examiner*—Carl D. Price
*Attorney, Agent, or Firm*—Burns, Doane, Swecker & Mathis, L. L. P.

[57] ABSTRACT

In a burner for operating a combustion chamber, which burner essentially comprises a swirl generator (100) and a mixing section (220) arranged downstream of the swirl generator, this mixing section acting upstream of a combustion chamber (30), the swirl flow induced by the swirl generator (100) is directed via transition passages (201) into the mixing section (220). At the outlet of a mixing tube (20) belonging to the mixing section (220), the burner front (70) of the mixing tube (20) is provided with at least one torus-like notch (71) on the combustion-chamber side. Thus the stability of the backflow zone (50) can be intensified, which has a positive effect on the combustion from all aspects.

17 Claims, 7 Drawing Sheets

BURNER FOR OPERATING A COMBUSTION CHAMBER

BACKGROUND OF THE INVENTION

1. Field of the Invention

The present invention relates to a burner for operating a combustion chamber.

2. Discussion of Background

EP-0 704 657 has already disclosed a burner which consists of a swirl generator on the incident-flow side, the flow formed herein being passed smoothly into a mixing section. This is done with the aid of a transition geometry, which is formed at the start of the mixing section for this purpose and consists of transition passages which cover sectors of the end face of the mixing section, in accordance with the number of acting sectional bodies of the swirl generator, and run helically in the direction of flow. On the outflow side of these transition passages, the mixing section has a number of prefilming bores, which ensure that the flow velocity along the tube wall is increased. This is then followed by a combustion chamber, the transition between the mixing section and the combustion chamber being formed by a jump in cross section, in the plane of which a backflow zone or backflow bubble forms.

The swirl intensity in the swirl generator is therefore selected in such a way that the breakdown of the vortex does not take place inside the mixing section but further downstream, as explained above in the region of the jump in cross section. The length of the mixing section is dimensioned in such a way that an adequate mixing quality is ensured for all types of fuel.

Although this burner, compared with those from the prior art, has brought about a significant improvement with regard to intensification of the flame stability, lower pollutant emissions, lower pulsations, complete burn-out, large operating range, good cross ignition between the various burners, compact type of construction, improved mixing, etc., it is found that a further intensification of the flame stability as well as an improved adaptation of the flame to the predetermined geometry of the combustion chamber has become necessary for smooth operation at the highest level in the premix combustion of the newer generation.

SUMMARY OF THE INVENTION

Accordingly, one object of the invention, as defined in the claims, it to propose in a burner of the aforementioned type novel measures which bring about an intensification of the flame stability and an adaptation of the flame to the predetermined geometry of the combustion chamber without reducing the other advantages of this burner in any way.

For this purpose, the burner front is formed with a torus or torus-like notch on the combustion-chamber side at the end of the mixing section in the plane of the jump in cross section. This configuration causes the combustion air flowing through the mixing section to come in contact with the flow forming in the torus, whereby the swirl coefficient of the main flow increases considerably. Compared with a flow without a torus, the backflow bubble forming in the region of the jump in cross section is greatly enlarged. This enlargement is characterized by a radial extension and axial compactness. This results in an intensification of the flame stability and in the possibility of carrying out a specific adaptation of the flame to the predetermined geometry of the combustion chamber by appropriate design of the torus.

A further refinement of the invention relates to the shifting-back of the head-side fuel nozzle relative to the inflow of the combustion air into a conical swirl generator having tangential air-inlet slots. The orifice of the fuel nozzle comes to lie upstream of the inflow region due to this shifting, so that the fuel spray from the fuel nozzle can be injected with a larger spray radius into the main flow. This measure ensures that the fuel spray has disintegrated from a film into droplets upon initial contact with the combustion air, and that the cone surface area of this fuel spray has increased by a factor of 3 in this region, which improves the spread of the fuel spray and does not impair the inflow of the combustion air.

If the fuel nozzle ends up in the region of a fixed casing due to being shifted back, openings can then be provided around the orifice of the fuel nozzle, through which openings purging air flows into the cross section induced by the fuel nozzle. The cross section of flow of these purging-air openings as well as the shifting-back of the fuel nozzle are selected in such a way that the purging air flowing through these openings is not sufficient in gas operation to displace the backflow bubble already mentioned above further downstream. In liquid-fuel operation, the fuel spray acts virtually as a jet pump, whereby the purging-air flow through the said openings increases in such a way that a greater axial impulse results, which displaces the backflow bubble further downstream.

A further advantage of the invention may be seen in the fact that the purging air through the openings in the region of the orifice of the fuel nozzle prevents wetting of the inner wall of the conical swirl generator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
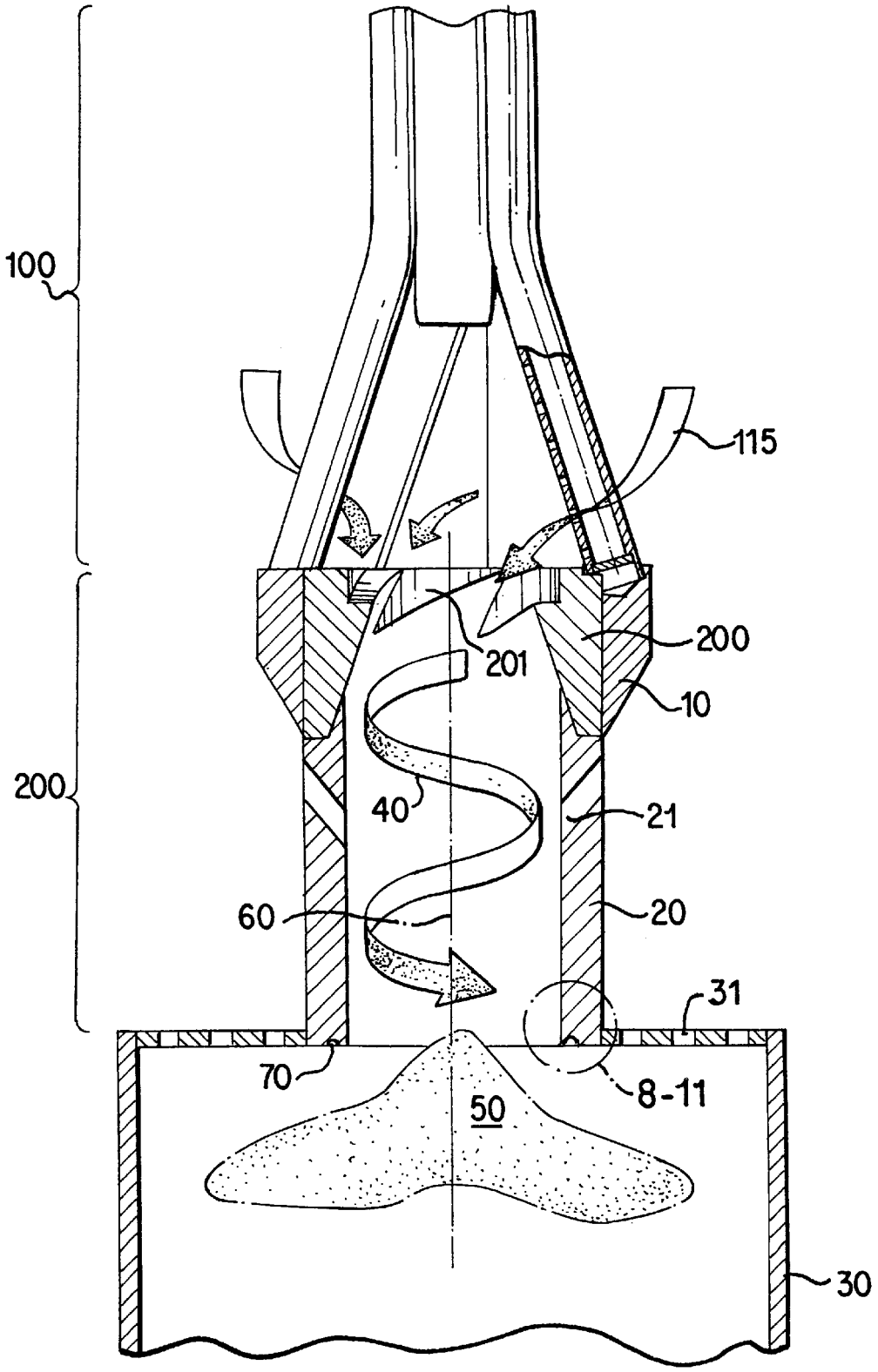
FIG. 1 shows a burner designed as a premix burner and having a mixing section downstream of a swirl generator.

Referring now to the drawings, wherein like reference numerals designate identical or corresponding parts throughout the several views, all features not essential for directly understanding the invention have been omitted, and the direction of flow of the media is indicated by arrows, FIG. 1 shows the overall construction of a burner. Initially a swirl generator 100 is effective, the configuration of which is shown and described in more detail below in FIGS. 2 to 5. This swirl generator 100 is a conical structure, to which a combustion-air flow 115 flowing in tangentially is repeatedly admitted tangentially. The flow forming herein, with the aid of a transition geometry provided downstream of the swirl generator 100, is passed over smoothly into a transition piece 200 in such a way that no separation regions can occur there. The configuration of this transition geometry is described in more detail under FIG. 6. This transition piece 200 is extended on the outflow side of the transition geometry by a mixing tube 20, both parts forming the actual mixing section 220. The mixing section 220 may of course be made in one piece, i.e. by the transition piece 200 and the mixing tube 20 being fused to form a single cohesive structure, the characteristics of each part being retained. If transition piece 200 and mixing tube 20 are constructed from two parts, these parts are connected by a sleeve ring 10, the same sleeve ring 10 serving as an anchoring surface for the swirl generator 100 on the head side. In addition, such a sleeve ring 10 has the advantage that various mixing tubes may be used. Located on the outflow side of the mixing tube 20 is the actual combustion chamber 30, which is symbolized here merely by a flame tube. The mixing section 220 largely fulfils the function of providing a defined section downstream of the swirl generator 100, in which section perfect premixing of fuels of various types can be achieved. Furthermore, this mixing section, that is, primarily the mixing tube 20, enables the flow to be directed free of losses so that at first no backflow zone or backflow bubble can form even in interaction with the transition geometry, whereby the mixing quality for all types of fuel can be influenced over the length of the mixing section 220. However, this mixing section 220 has another property, which consists in the fact that in the mixing section 220 itself the axial velocity profile has a pronounced maximum on the axis, so that a flashback of the flame from the combustion chamber is not possible. However, it is correct to say that this axial velocity decreases toward the wall in such a configuration. In order to also prevent flashback in this region, the mixing tube 20 is provided in the direction of flow and in the peripheral direction with a number of regularly or irregularly distributed bores 21 having the most varied cross sections and directions, through which an air quantity flows into the interior of the mixing tube 20 and induces an increase in the velocity along the wall for the purposes of a prefilmer. Another possibility of achieving the same effect is for the cross section of flow of the mixing tube 20 on the outflow side of the transition passages 201, which form the transition geometry already mentioned, to undergo a convergence, as a result of which the entire velocity level inside the mixing tube 20 is raised. In the figure, these bores 21 run at an acute angle relative to the burner axis 60. Furthermore, the outlet of the transition passages 201 corresponds to the narrowest cross section of flow of the mixing tube 20. The said transition passages 201 therefore bridge the respective difference in cross section without at the same time adversely affecting the flow formed. If the measure selected initiates an intolerable pressure loss when directing the tube flow 40 along the mixing tube 20, this may be remedied by a diffuser (not shown in the figure) being provided at the end of this mixing tube. A combustion chamber 30 then adjoins the end of the mixing tube 20, there being a jump in cross section, formed by a burner front 70, between the two cross sections of flow. Only here does a central backflow zone 50 form, which has the properties of a bodiless flame retention baffle. If a fluidic marginal zone forms inside this jump in cross section during operation, in which marginal zone vortex separations arise due to the vacuum prevailing there, this leads to intensified ring stabilization of the backflow zone 50. At the end face, the combustion chamber 30 has a number of openings 31 through which an air quantity flows directly into the jump in cross section and contributes there, inter alia, to the ring stabilization of the backflow zone so being intensified. In addition, it must not be left unmentioned that the generation of a stable backflow zone 50 also requires a sufficiently high swirl coefficient in a tube. If such a high swirl coefficient is undesirable at first, stable backflow zones may be generated by the feed of small, intensely swirled air flows at the tube end, for example through tangential openings. It is assumed here that the air quantity required for this is approximately 5–20% of the total air quantity. As far as the configuration of the burner front 70 at the end of the mixing tube 20 for stabilizing the backflow zone or backflow bubble 50 is concerned, reference is made to the description under FIGS. 8–11.

Figure 2:
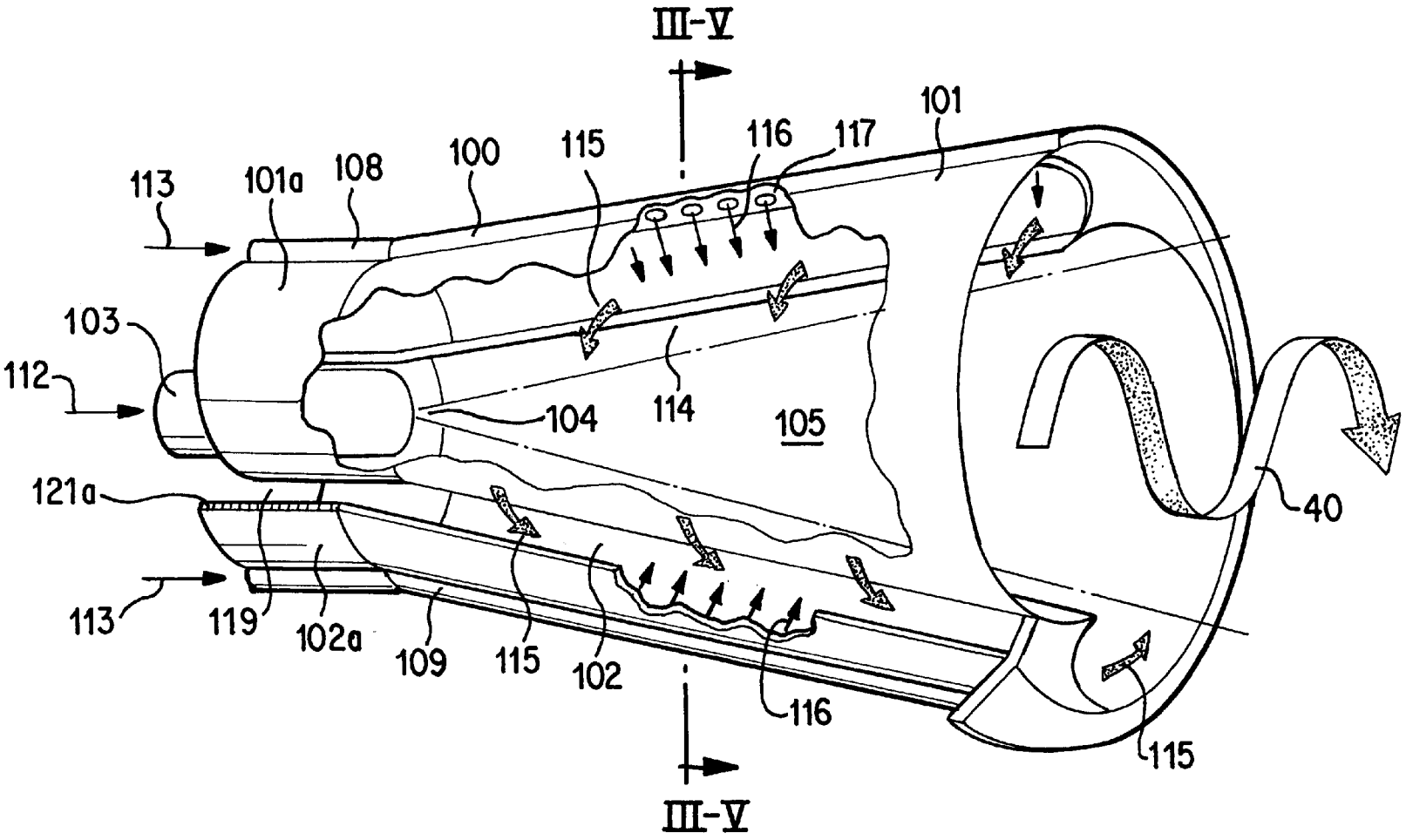
FIG. 2 shows a swirl generator consisting of a plurality of shells in perspective representation, in appropriate cut-away section.
Figure 3:
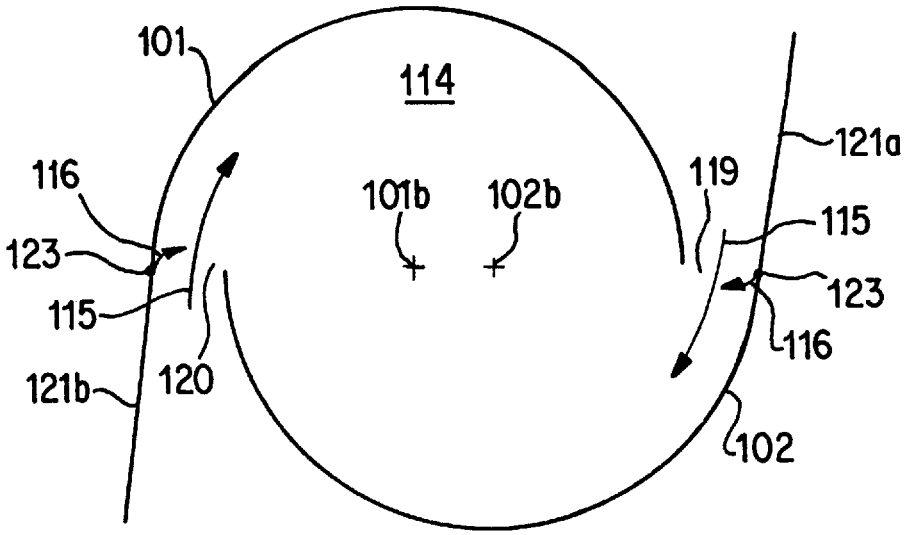
FIG. 3 shows a cross section through a two-shell swirl generator.

In order to better understand the construction of the swirl generator 100, it is of advantage if at least FIG. 3 is used at the same time as FIG. 2. Furthermore, so that this FIG. 2 is not made unnecessarily complex, the baffle plates 121*a*, 121*b* shown schematically according to FIG. 3 are only alluded to in FIG. 2. In the description of FIG. 2, the said figures are referred to below when required.

Figure 4:
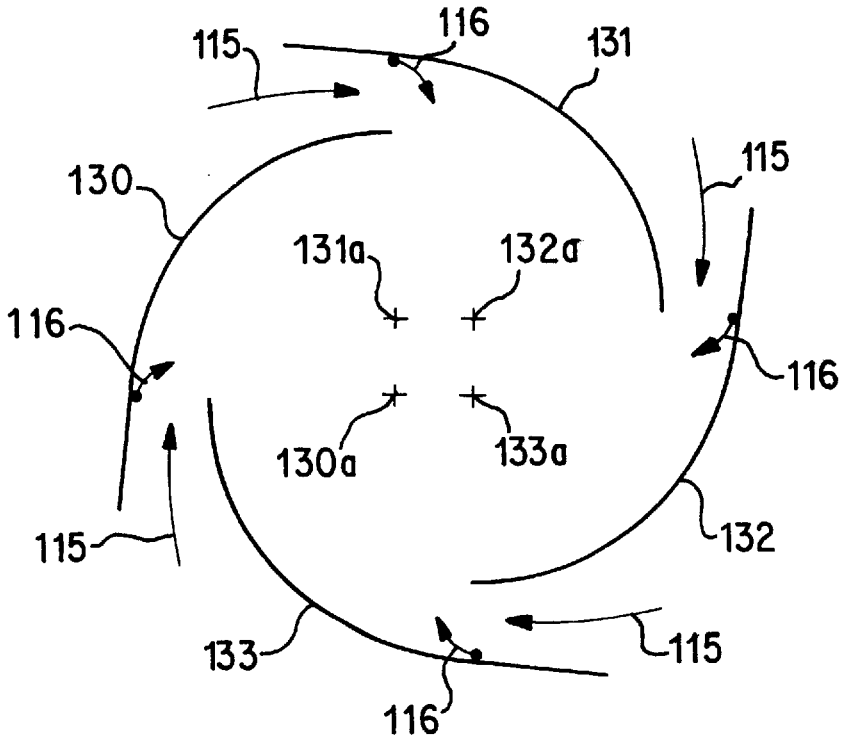
FIG. 4 shows a cross section through a four-shell swirl generator.
Figure 5:
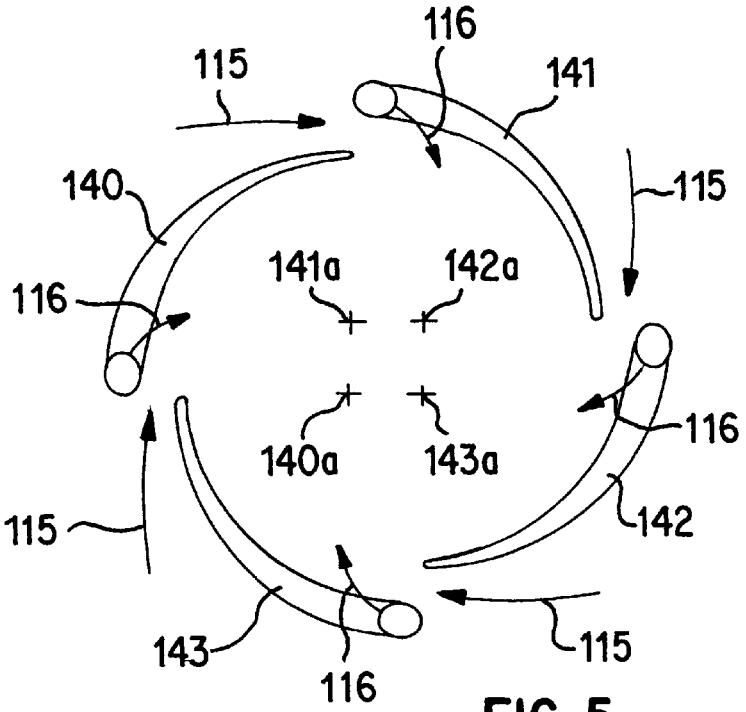
FIG. 5 shows a view of a swirl generator whose shells are profiled in a blade shape.

The first part of the burner according to FIG. 1 forms the swirl generator 100 shown according to FIG. 2. The swirl generator 100 consists of two hollow conical sectional bodies 101, 102 which are nested one inside the other in a mutually offset manner. The number of conical sectional bodies may of course be greater than two, as shown in FIGS. 4 and 5; this depends in each case on the mode of operation of the entire burner, as will be explained in more detail further below. It is not out of the question in certain operating configurations to provide a swirl generator consisting of a single spiral. The mutual offset of the respective center axis or longitudinal symmetry axes 201*b*, 202*b* of the conical sectional bodies 101, 102 provides at the adjacent wall, in mirror-image arrangement, one tangential duct each, i.e. an air-inlet slot 119, 120 (FIG. 3) through which the combustion air 115 flows into the interior space of the swirl generator 100, i.e. into the conical hollow space 114 of the same. The conical shape of the sectional bodies 101, 102 shown has a certain fixed angle in the direction of flow. Of course, depending on the operational use, the sectional bodies 101, 102 may have increasing or decreasing conicity in the direction of flow, similar to a trumpet or tulip respectively. The two last-mentioned shapes are not shown graphically, since they can readily be visualized by the person skilled in the art. The two conical sectional bodies 101, 102 each have a cylindrical initial part 101*a*, 102*a*, which parts likewise run offset from one another in a manner analogous to the conical sectional bodies 101, 102, so that the tangential air-inlet slots 119, 120 are present over the entire length of the swirl generator 100. Accommodated in the region of the cylindrical initial part is a nozzle 103, preferably for a liquid fuel 112, the injection 104 of which coincides approximately with the narrowest cross section of the conical hollow space 114 formed by the conical sectional bodies 101, 102. The injection capacity of this nozzle 103 and its type depend on the predetermined parameters of the respective burner. It is of course possible for the swirl generator 100 to be designed purely conically, that is, without cylindrical initial parts 101*a*, 102*a*. Furthermore, the conical sectional bodies 101, 102 each have a fuel line 108, 109, which fuel lines are arranged along the tangential air-inlet slots 119, 120 and are provided with injection openings 117, through which preferably a gaseous fuel 113 is injected into the combustion air 115 flowing through there, as the arrows 116 are intended to symbolize. These fuel lines 108, 109 are preferably positioned at the latest at the end of the tangential inflow, before entering the conical hollow space 114, in order to obtain optimum air/fuel mixing. As mentioned, the fuel 112 fed through the nozzle 103 is a liquid fuel in the normal case, a mixture formation with another medium being readily possible. This fuel 112 is injected at an acute angle into the conical hollow space 114. Thus a conical fuel spray 105 forms from the nozzle 103, which fuel spray 105 is enclosed by the rotating combustion air 115 flowing in tangentially. The concentration of the injected fuel 112 is continuously reduced in the axial direction by the inflowing combustion air 115 for mixing in the direction of vaporization. If a gaseous fuel 113 is injected via the opening nozzles 117, the fuel/air mixture is formed directly at the end of the air-inlet slots 119, 120. If the combustion air 115 is additionally preheated or, for example, enriched with a recycled flue gas or exhaust gas, this provides lasting assistance for the vaporization of the liquid fuel 112 before this mixture flows into the downstream stage. The same considerations also apply if liquid fuels are to be supplied via the lines 108, 109. Narrow limits per se are to be adhered to in the configuration of the conical sectional bodies 101, 102 with regard to the cone angle and the width of the tangential air-inlet slots 119, 120, so that the desired flow field of the combustion air 115 can develop at the outlet of the swirl generator 100. In general, it may be said that a reduction in the tangential air-inlet slots 119, 120 promotes the quicker formation of a backflow zone already in the region of the swirl generator. The axial velocity inside the swirl generator 100 can be changed by a corresponding feed (not shown) of an axial combustion-air flow. Corresponding swirl generation prevents the formation of flow separations inside the mixing tube arranged downstream of the swirl generator 100. Furthermore, the construction of the swirl generator 100 is especially suitable for changing the size of the tangential air-inlet slots 119, 120, whereby a relatively large operational range can be covered without changing the overall length of the swirl generator 100. The sectional bodies 101, 102 may of course also be displaced relative to one another in another plane, as a result of which even an overlap of the same may be provided. Furthermore, it is possible to nest the sectional bodies 101, 102 spirally one inside the other by a contra-rotating movement. It is thus possible to vary the shape, size and configuration of the tangential air-inlet slots 119, 120 as desired, whereby the swirl generator 100 can be used universally without changing its overall length.

The geometric configuration of the baffle plates 121*a*, 121*b* is now apparent from FIG. 3. They have a flow-initiating function, in which case, in accordance with their length, they extend the respective end of the conical sectional bodies 101, 102 in the incident-flow direction relative to the combustion air 115. The ducting of the combustion air 115 into the conical hollow space 114 can be optimized by opening or closing the baffle plates 121*a*, 121*b* about a pivot 123 placed in the region of the inlet of this duct into the conical hollow space 114, and this is especially necessary if the original gap size of the tangential air-inlet slots 119, 120 is to be changed dynamically. These dynamic measures may of course also be provided statically by baffle plates forming as and when required a fixed integral part with the conical sectional bodies 101, 102. The swirl generator 100 may likewise also be operated without baffle plates or other aids may be provided for this.

FIG. 4, in comparison with FIG. 3, shows that the swirl generator 100 is now composed of four sectional bodies 130, 131, 132, 133. The associated longitudinal symmetry axes for each sectional body are identified by the letter a. Of this configuration it may be said that, on account of the smaller swirl intensity thus produced and in interaction with a correspondingly increased slot width, it is best suited to prevent the breakdown of the vortex flow on the outflow side of the swirl generator in the mixing tube, whereby the mixing tube can best fulfil the role intended for it.

FIG. 5 differs from FIG. 4 inasmuch as the sectional bodies 140, 141, 142, 143 here have a blade-profile shape, which is provided for supplying a certain flow. Otherwise, the mode of operation of the swirl generator is kept the same. The admixing of the fuel 116 with the combustion-air flow 115 is effected from the interior of the blade profiles, i.e. the fuel line 108 is now integrated in the individual blades. Here, too, the longitudinal symmetry axes for the individual sectional bodies are identified by the letter a.

Figure 6:
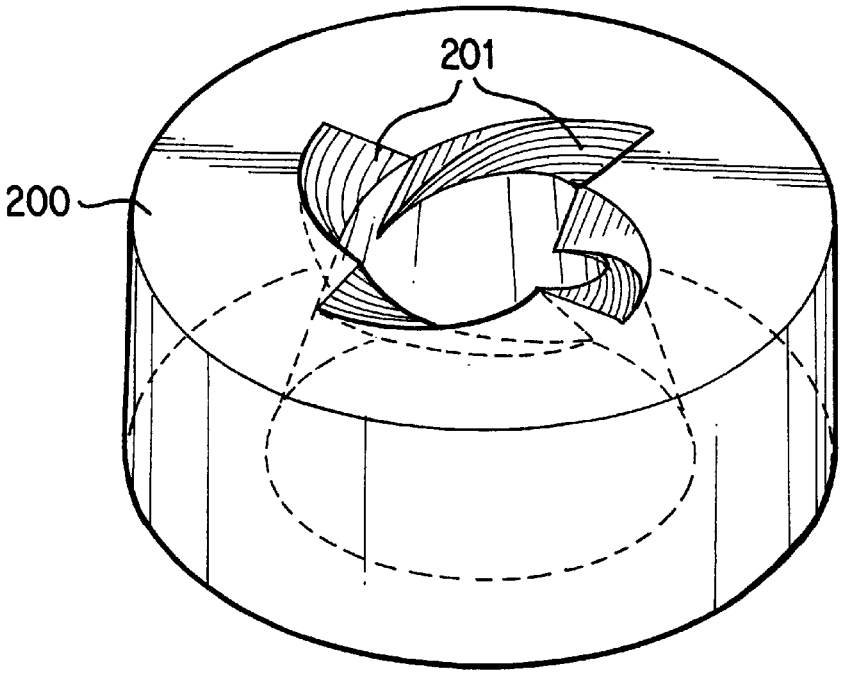
FIG. 6 shows a configuration of the transition geometry between swirl generator and mixing section.

FIG. 6 shows the transition piece 200 in a three-dimensional view. The transition geometry is constructed for a swirl generator 100 having four sectional bodies in accordance with FIG. 4 or 5. Accordingly, the transition geometry has four transition passages 201 as a natural extension of the sectional bodies acting upstream, as a result of which the cone quadrant of the said sectional bodies is extended until it intersects the wall of the mixing tube. The same considerations also apply when the swirl generator is constructed from a principle other than that described under FIG. 2. The surface of the individual transition passages 201 which runs downward in the direction of flow has a form which runs spirally in the direction of flow and describes a crescent-shaped path, in accordance with the fact that in the present case the cross section of flow of the transition piece 200 widens conically in the direction of flow. The swirl angle of the transition passages 201 in the direction of flow is selected in such a way that a sufficiently large section subsequently still remains for the tube flow up to the jump in cross section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube produce a distinct increase in the axial velocity profile toward the center of the mixing tube, so that the risk of premature ignition is decisively counteracted.

Figure 7:
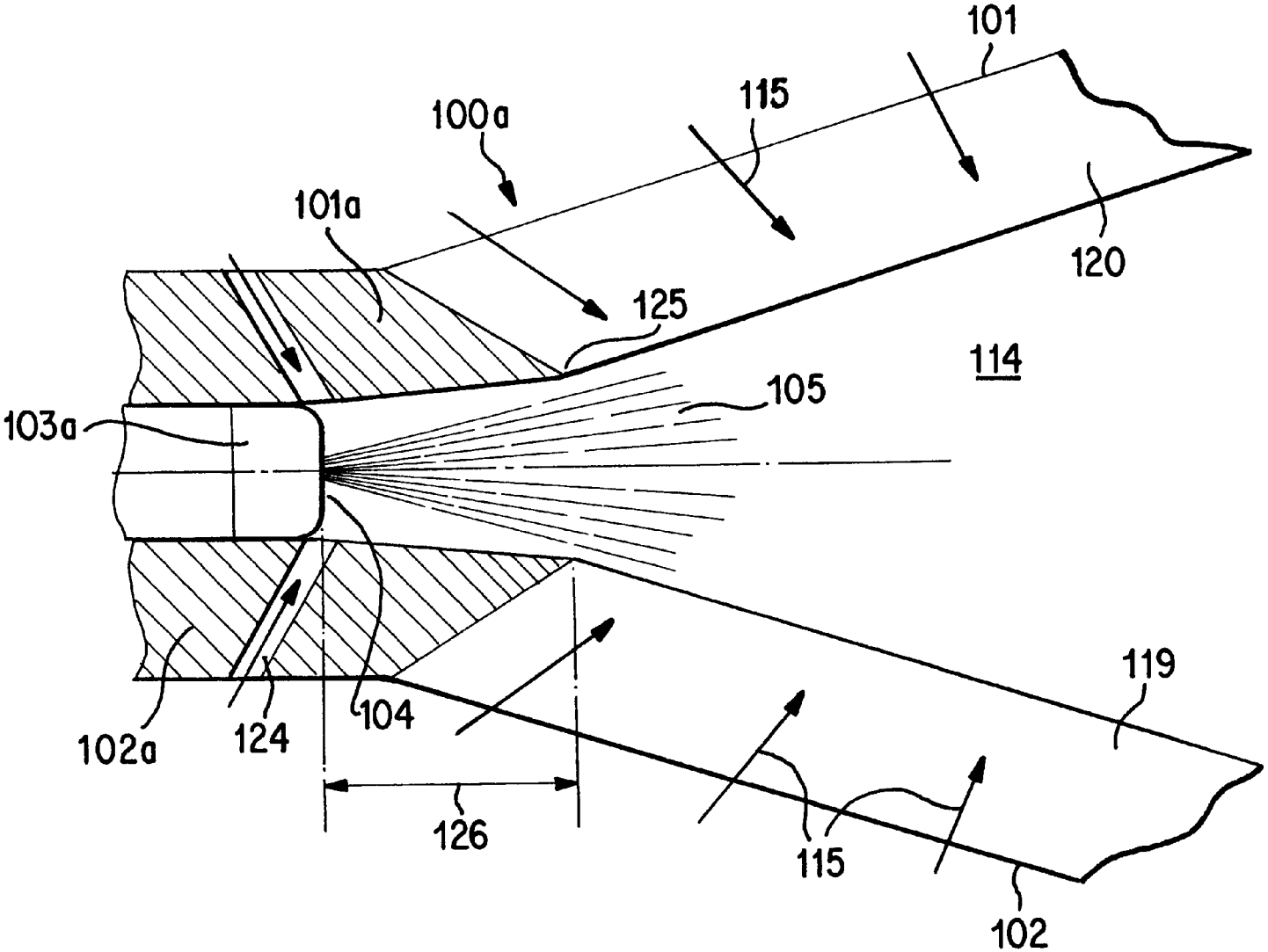
FIG. 7 shows a schematic representation of the swirl generator according to FIG. 2 with shifted-back fuel nozzle.

FIG. 7 shows a schematic representation of a swirl generator 100*a*, which has been described in more detail in the preceding FIGS. 2–5. The essential aspect of FIG. 7 is the representation of the centrally placed fuel nozzle 103*a*, which is shifted back upstream relative to the start 125 of the conical cross section of flow, the distance 126 depending on the spray angle 105 selected, and it is about as long as the diameter of the cross section there. The orifice 104 of the fuel nozzle 103*a* ends up in the region of the fixed casing 101*a*, 102*a* on the head side due to this shifting. The fuel spray 105 produced due to the fuel nozzle 103*a* being shifted back enters with a larger cone radius into the region covered by the main flow of the combustion air into the interior space 114 of the burner, so that the fuel spray 105 in this region no longer behaves as a solid compact body but has already disintegrated into droplets and therefore can easily be penetrated. The inflow of the combustion air 115 into the fuel spray 105 is no longer hindered, a factor which has a positive effect on the mixing quality owing to the fact that the fuel spray 105 can be penetrated more easily by the combustion air. In addition, radially or quasi-radially arranged openings 124 are provided in the region of the plane of the fuel-spray orifice 104, through which openings 124 purging air flows into the cross section induced by the size of the fuel nozzle 103*a*. The cross section of flow of these openings 124 is selected in such a way that the air mass flow through these openings is not sufficient in gas operation to displace the backflow zone (cf. FIG. 1) further downstream. In liquid-fuel operation, the fuel spray 105 acts virtually as a jet pump, whereby the air mass flow through the said openings 124 increases. This produces a greater axial impulse, which displaces the backflow zone further downstream, which acts as a good measure against a flashback of the flame. The schematically shown conical sectional bodies 101, 102 are dealt with in more detail in FIGS. 2–5. The configuration and mode of operation of the tangential air-inlet slots 119, 120 are also dealt with in more detail there.

Figure 8:
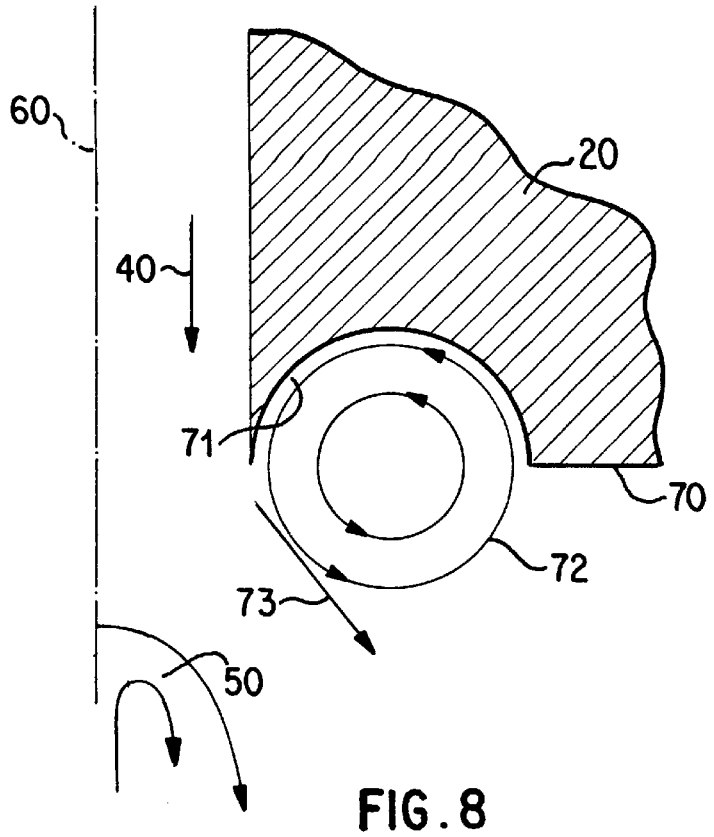
FIGS. 8–11 show various torus-like configurations in the burner front for stabilizing the backflow bubble.

FIG. 8 shows how a torus 71 is recessed on the combustion-chamber side at the end of the mixing tube 20 along the radial end edge, which forms the burner front 70. In principle, the size of this torus depends on the main flow 40 inside the mixing tube 20 belonging to the mixing section: the torus 71 is selected in such a way that the main flow 40 comes in contact with a torus flow 72 formed by it, whereby the swirl coefficient increases considerably. At the same time, a deflected main flow 73 running obliquely relative to the burner axis 60 results from this contact, which main flow 73 develops tangentially to the torus flow 72. These flow dynamics induced by the torus 71 are responsible for the fact that the backflow bubble 50 is greatly enlarged compared with a flow without a torus, as is indicated diagrammatically in FIG. 1, and hence induces an intensification of the flame stabilization in this region. The torus 71 apparent from FIG. 8 describes a semicircle, starting at the inner edge of the mixing tube 20. The remaining end edge 70 in the radial direction remains unchanged beyond the profile of the semicircular torus 71.

Figure 9:
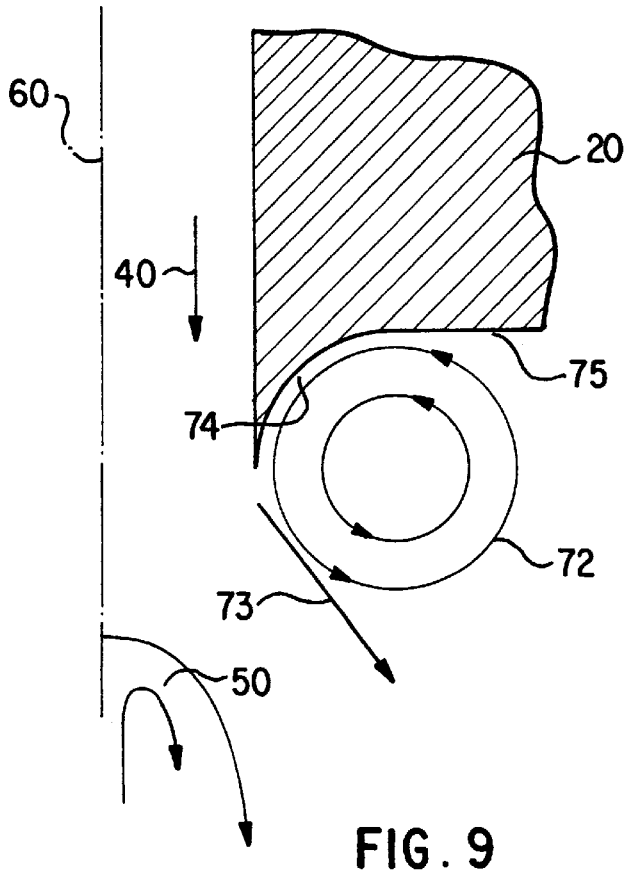

FIG. 9 shows a further configuration of the torus. The torus now has a quadrant-shaped profile 74 and then merges into a radial end edge 75, which is offset from the original burner front 70 according to FIG. 8. Here, too, a considerable increase in the swirl coefficient results, and an intensification of the backflow bubble 50 results for the reasons explained above.

It can already be seen from these two examples that the torus can be formed in several ways. It is important here that the torus flow 72 is driven by the main flow 40, and the latter is then deflected in accordance with the illustrations.

Figure 10:
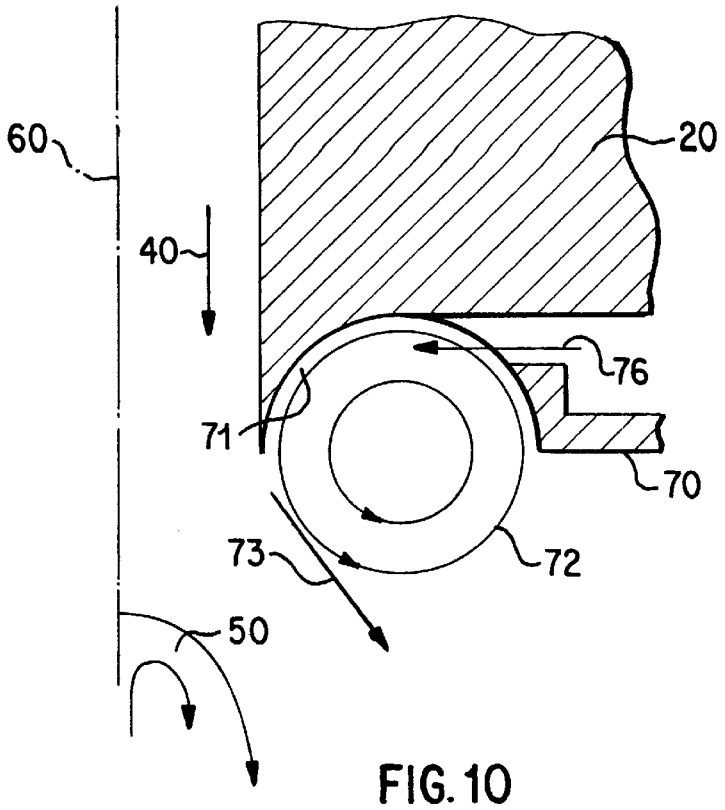

FIG. 10, as far as the profile of the torus 71 is concerned, corresponds to the configuration according to FIG. 8. The further development relates here to the torus flow 72, which in addition to the main flow 40 is also driven by a secondary flow 76. This secondary flow 76 at the same time forms a cooling-air flow for the end edge 70 forming the burner front.

Figure 11:
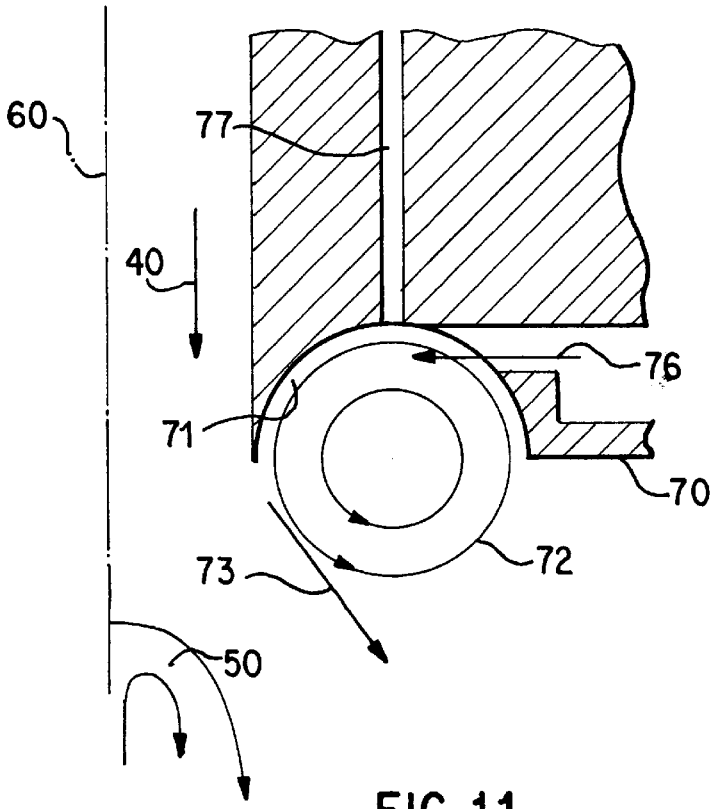

FIG. 11 is a further development of FIG. 10, it being shown here how it is possible in principle to also incorporate a pilot stage 77 in connection with the formation of the torus flow 72. An axially running passage belonging to the pilot stage 77 introduces fuel into the torus flow 72 and provides for fuel piloting, this passage entering approximately at the highest point of the torus 71.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for operating a combustion chamber, comprising:

a swirl generator for a combustion-air flow, said swirl generator having an upstream end and a downstream end, an inner wall defining a chamber, and at least one throughflow opening for introducing combustion-air into said chamber;

means for injecting a fuel into said swirl generator chamber;

a transition section downstream of and in communication with said swirl generator chamber and having an upstream end, a downstream end, an inner wall defining a passageway, and at least one transition passage on said transition section inner wall;

a mixing tube downstream of and in communication with said transition section passageway and having an upstream end, a downstream end, an inner wall defining a passageway, and a burner front face defining a combustion-chamber opening from said mixing tube passageway;

wherein, when said means for injecting fuel injects fuel into the combustion-air flow and combustion-air flows through said burner, said swirl generator generates a plurality of partial flows of combustion-air, said plurality of partial flows comprising one partial flow emerging from each of said at least one throughflow opening, and the number of said at least one transition passage equals that number of said at least one throughflow opening and partial flows;

wherein said swirl generator, said transition section, and said mixing tube are arranged on a common longitudinal axis and offset in a longitudinal direction, said downstream end of said swirl generator facing said upstream end of said transition section, said downstream end of said transition section facing said upstream end of said mixing tube;

wherein said at least one transition passage is arranged on said transition section inner wall and providing a smooth transition from said swirl generator inner wall to said mixing tube inner wall for each partial flow, said mixing tube inner wall being adjacent to the burner front face, said burner front face being arranged substantially perpendicular to said common longitudinal axis at said mixing tube downstream end; and said burner front face comprising a circumferential notch having an at least partially circular cross section.

2. The burner as claimed in claim 1, wherein said circumferential notch describes a semicircular cross section.

3. The burner as claimed in claim 1, wherein said burner front face further comprises an end edge offset from said burner front face, and said circumferential notch describes a quadrant cross section which merges into said end edge.

4. The burner as claimed in claim 1, wherein said mixing tube inner wall meets said burner front face at a transition section, and an innermost portion of said circumferential notch begins at said transition section.

5. The burner as claimed in claim 1, wherein said circumferential notch comprises at least one passage, leading into said circumferential notch, for the inflow of secondary air, a fuel, or both.

6. The burner as claimed in claim 1, wherein a portion of said mixing tube downstream of said transition passages comprises openings directed peripherally downstream for injecting an air flow into said mixing tube.

7. The burner as claimed in claim 6, wherein said peripherally downstream directed openings run at an acute angle relative to said common longitudinal axis in said mixing tube.

8. The burner as claimed in claim 1, wherein the cross section of flow of said mixing tube passageway downstream of said transition passages is substantially equal to the cross section at said swirl generator downstream end.

9. The burner as claimed in claim 1, further comprising a combustion chamber downstream of said mixing section having a cross sectional dimension said mixing section having a cross sectional dimension, and comprising a jump in cross sectional dimension between said combustion chamber cross sectional dimension and said mixing section cross sectional dimension to induce flow into said combustion chamber, said jump in cross sectional dimension permitting a backflow zone to form adjacent to said jump in cross sectional dimension.

10. The burner as claimed in claim 1, further comprising a flow modifying element upstream of said burner front face selected from the group consisting of a diffuser, a venturi, and both.

11. The burner as claimed in claim 1, wherein said swirl generator comprises at least two hollow, conical sectional bodies nested one inside the other in the direction of flow, each sectional body having walls and a longitudinal symmetry axis, said sectional body walls together forming an interior space including aid swirl generator chamber, said sectional body longitudinal axes being mutually offset such that adjacent walls of said sectional bodies form longitudinally extending combustion-air flow ducts for a combustion-air flow which tangentially intersect said interior space, and further comprising at least one fuel nozzle arranged in said interior space.

12. The burner as claimed in claim 11, wherein said at least one fuel nozzle comprises a plurality of fuel nozzles adjacent to said combustion-air ducts.

13. The burner as claimed in claim 11, wherein said sectional bodies have a blade-shaped profile in cross section.

14. The burner as claimed in claim 11, wherein said sectional bodies have a cone angle selected from the group consisting of a fixed cone angle, increasing conicity downstream, and decreasing conicity downstream.

15. The burner as claimed in claim 11, wherein said sectional bodies are nested spirally one inside the other.

16. The burner as claimed in claim 11, wherein said fuel nozzle is positioned upstream relative to upstream ends of said combustion-air ducts by a distance.

17. The burner as claimed in claim 16, further comprising passages positioned upstream of said at least one fuel nozzle for the inflow of secondary air, said passages extending at least in a radial direction.

* * * * *